US012582917B2

(12) United States Patent
Hunter et al.

(10) Patent No.: US 12,582,917 B2
(45) Date of Patent: Mar. 24, 2026

(54) SLIDE FEATURE FOR WATER RIDE

(71) Applicant: ProSlide Technology Inc., Ottawa (CA)

(72) Inventors: Richard D. Hunter, Ottawa (CA); Jonathan Brazeau, Richmond (CA)

(73) Assignee: Proslide Technology Inc., Ottawa (CA)

( * ) Notice: Subject to any disclaimer, the term of this patent is extended or adjusted under 35 U.S.C. 154(b) by 92 days.

(21) Appl. No.: 18/286,290

(22) PCT Filed: Apr. 12, 2022

(86) PCT No.: PCT/CA2022/050561

§ 371 (c)(1),
(2) Date: Oct. 10, 2023

(87) PCT Pub. No.: WO2022/217347

PCT Pub. Date: Oct. 20, 2022

(65) Prior Publication Data

US 2024/0207747 A1 Jun. 27, 2024

Related U.S. Application Data

(60) Provisional application No. 63/173,773, filed on Apr. 12, 2021.

(51) Int. Cl.
*A63G 21/18* (2006.01)

(52) U.S. Cl.
CPC ..... *A63G 21/18* (2013.01)

(58) Field of Classification Search
CPC ..... A63G 21/10
USPC ..... 472/117
See application file for complete search history.

(56) References Cited

U.S. PATENT DOCUMENTS 1,186,966 A * 6/1916 Bramkamp ..... A63G 25/00 472/28
4,145,042 A 3/1979 Becker et al.
4,194,733 A * 3/1980 Whitehouse, Jr. ..... A63G 21/18 472/117
4,196,900 A * 4/1980 Becker ..... A63G 21/00 472/117
5,598,914 A 2/1997 Sulzer et al.
(Continued)

FOREIGN PATENT DOCUMENTS

DE 202009014520 U1 4/2011

OTHER PUBLICATIONS

European Search Report in counterpart European Application No. 22787191 dated Jan. 21, 2025 (9 pages).
(Continued)

*Primary Examiner* — Joseph A Dillon, Jr.
(74) *Attorney, Agent, or Firm* — Finnegan, Henderson, Farabow, Garrett & Dunner, LLP

(57) ABSTRACT

A slide feature for a water ride is disclosed. The slide feature includes an at least partially closed interior space partly defined by a flume open to the interior space. The flume has a spiral or helical path around the interior space with at least one turn such that a first part of the flume extends adjacent to and spaced from a second part of the flume. A connecting wall portion spans the space between the first and second parts of the flume to partially enclose the interior space. An inrun permits ingress into the flume. An outrun permitting egress out of the flume.

43 Claims, 12 Drawing Sheets

(56) References Cited

U.S. PATENT DOCUMENTS

| | | | | |
|---|---|---|---|---|
| 8,192,291 | B2 | 6/2012 | Brassard et al. | |
| D779,010 | S * | 2/2017 | Ozturk | D21/821 |
| D1,052,679 | S * | 11/2024 | Hunter | D21/814 |
| 2009/0239671 | A1 | 9/2009 | Brassard et al. | |
| 2019/0247759 | A1 | 8/2019 | Ozturk | |

OTHER PUBLICATIONS

International Search Report, PCT/CA2022/050561, dated Jun. 17, 2022.

* cited by examiner

SLIDE FEATURE FOR WATER RIDE

FIELD

This application relates generally to amusement rides and, more specifically, water slide features for water rides.

BACKGROUND

In conventional water-based amusement rides, such as large-scale water slides featured at amusement parks, patrons enter the ride at a high elevation and travel to a terminal destination at a lower elevation by sliding along a chute or flume. To facilitate sliding, portions of a water slide may be lubricated with a volume of water.

Depending on the configuration of a ride, patrons ride directly on the sliding surface of the slide or are carried by a vehicle. Some such vehicles include mats, tubes and boats.

The thrill and excitement experienced by riders is a function of a number of factors, including the speed, forces, visual effects, and auditory effects experienced by riders.

The amusement park industry is competitive and evolving. Park operators strive to offer new, innovative rides to provide exciting and thrilling experiences for patrons. Thus, there is a desire to develop new and exciting flume geometries.

SUMMARY

According to some embodiments of the present disclosure, there is provided a slide feature for a water ride adapted to carry a rider or ride vehicle sliding thereon, the slide feature comprising: an at least partially closed interior space partly defined by a flume open to the interior space, the flume having a spiral or helical path around the interior space with at least one turn such that a first part of the flume extends adjacent to and spaced from a second part of the flume, and a connecting wall portion spanning the space between the first and second parts of the flume to partially enclose the interior space; an inrun permitting ingress into the flume; and an outrun permitting egress out of the flume.

In some embodiments, the inrun is at a first elevation and the outrun is at a second elevation, the first and second elevations being different from each other.

In some embodiments, the connecting wall portion extends from the first part of the flume to the second part of the flume.

In some embodiments, an opening of the open flume is defined between a top edge of the flume and a bottom edge of the flume, and the connecting wall portion extends from the bottom edge of the first part of the flume to the top edge of the second part of the flume.

In some embodiments, the connecting wall portion is curved inwards towards the interior space.

In some embodiments, there is provided a top wall portion to at least partially enclose a top of the interior space.

In some embodiments, the top wall portion extends from the flume.

In some embodiments, an opening of the open flume is defined between a top edge of the flume and a bottom edge of the flume, and the top wall portion extends from the top edge of the flume.

In some embodiments, the top wall portion merges with the connecting wall portion.

In some embodiments, the top wall portion merges with a side wall of the inrun.

In some embodiments, there is provided a bottom wall portion to at least partially enclose a bottom of the interior space.

In some embodiments, the bottom wall portion extends from the flume.

In some embodiments, an opening of the open flume is defined between a top edge of the flume and a bottom edge of the flume, and the bottom wall portion extends from the bottom edge of the flume.

In some embodiments, the bottom wall portion merges with the connecting wall portion.

In some embodiments, the bottom wall portion merges with a side wall of the outrun.

In some embodiments, the flume has a helical or spiral path around an axis of the slide feature, the axis being vertical or tilted from the vertical.

In some embodiments, the flume has a helical path with a constant radius of curvature.

In some embodiments, a radius of curvature of the inrun reduces from a start of the inrun until it matches a radius of curvature of the flume.

In some embodiments, a radius of curvature of the outrun increases from a radius of curvature of the flume until an end of the outrun.

In some embodiments, the inrun transitions from a closed flume to the open flume.

In some embodiments, the outrun transitions from the open flume to a closed flume.

In some embodiments, the flume is a first flume and the slide feature further comprises at least one flume arranged adjacent to the first flume with an opening arranged between the first flume and the adjacent flume.

In some embodiments, the flume is a first flume and the slide feature further comprises one or more further flumes arranged in a helical configuration with the first flume.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there is shown in the drawings illustrative embodiments of the disclosure. It should be understood, however, that the application is not limited to the precise arrangements and instrumentalities shown. In the drawings.

DETAILED DESCRIPTION

Figure 1:
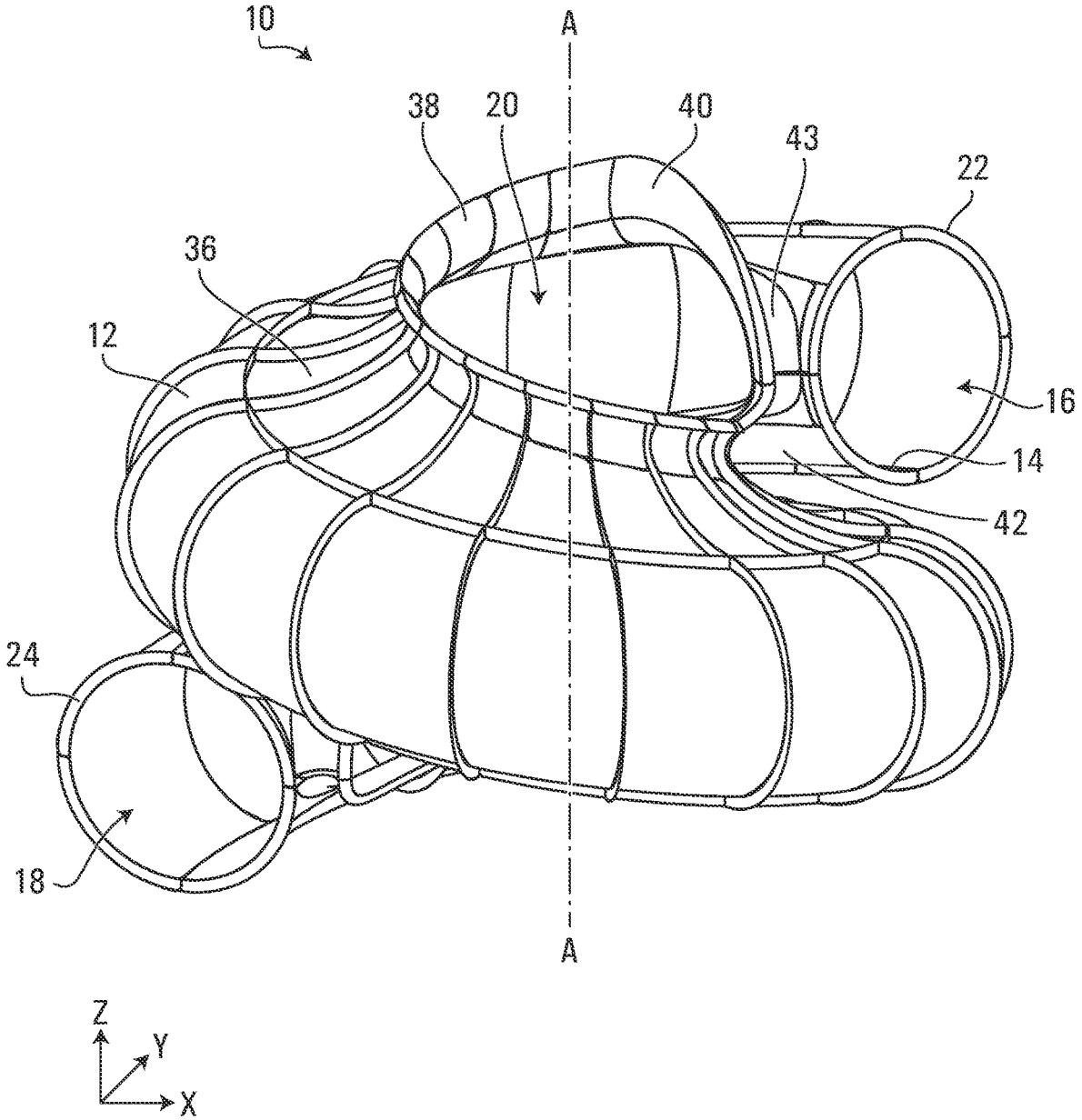
FIG. 1 is a top perspective view of a slide feature according to embodiments of the present disclosure.
Figure 2:
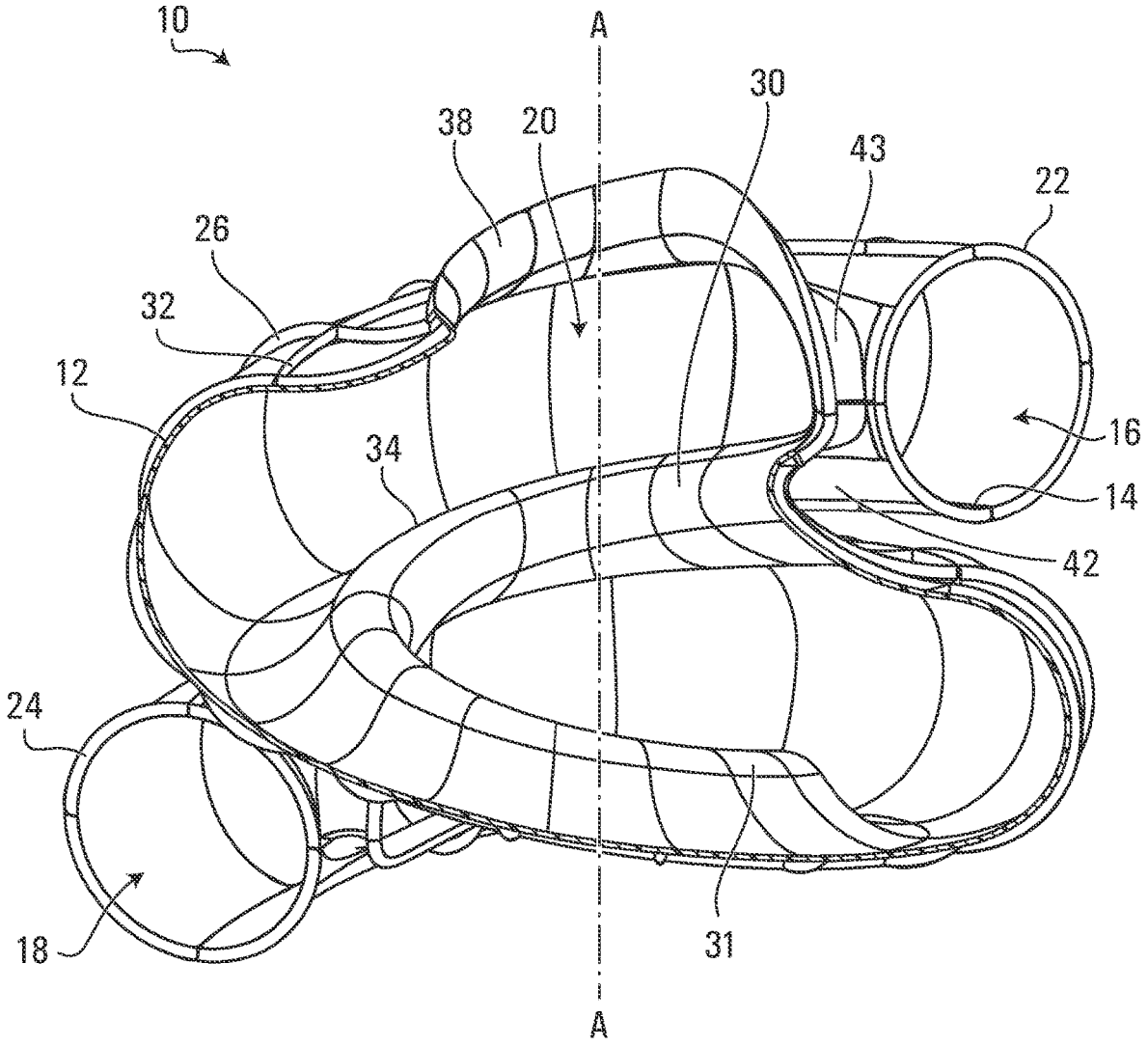
FIG. 2 is the view of FIG. 1 with a section of the slide feature cut out.
Figure 3:
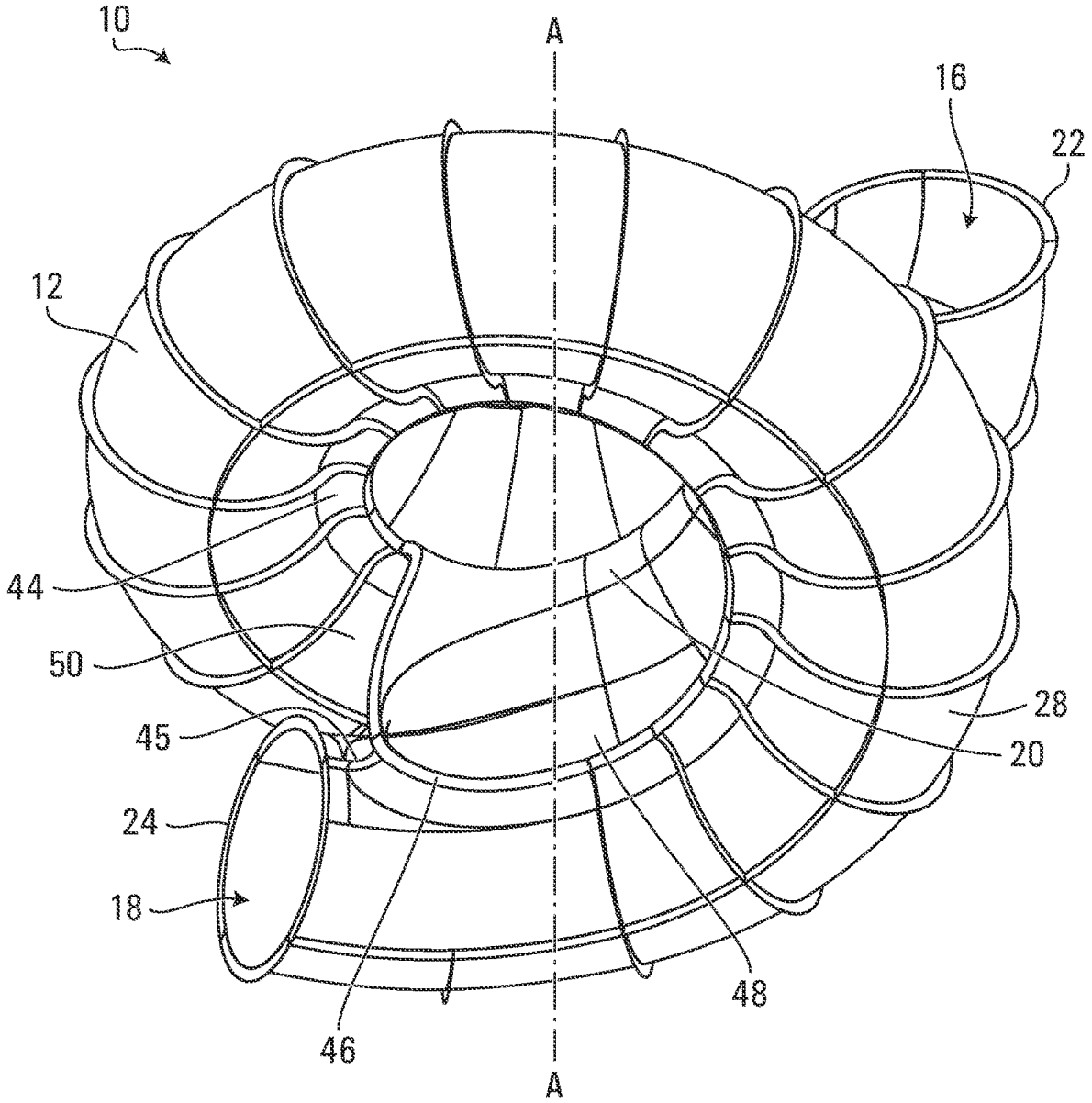
FIG. 3 is a bottom perspective view of the slide feature of FIG. 1.
Figure 4:
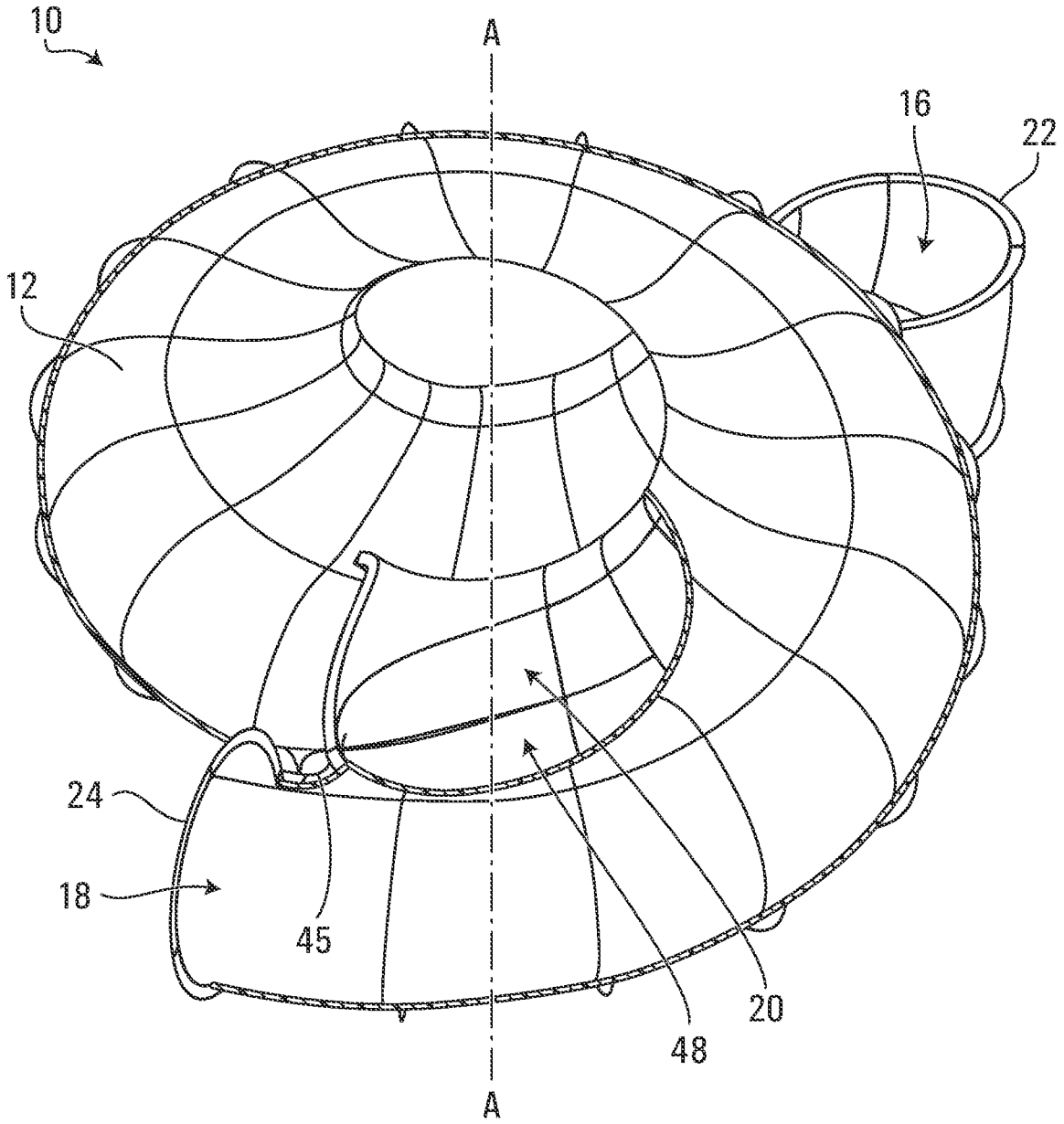
FIG. 4 is the view of FIG. 3 with a section of the slide feature cut out.
Figure 5:
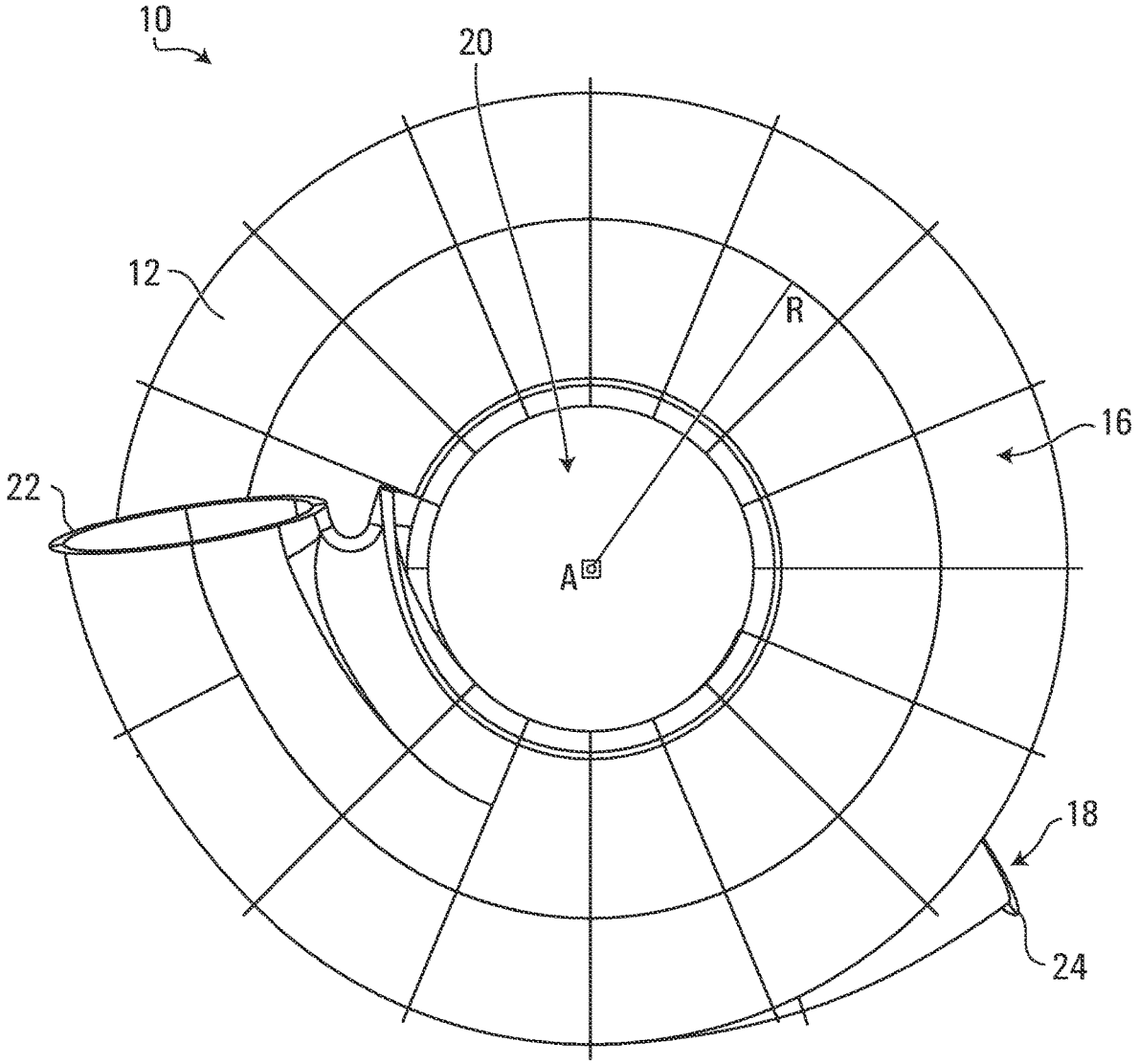
FIG. 5 is a top of the slide feature of FIG. 1.
Figure 6:
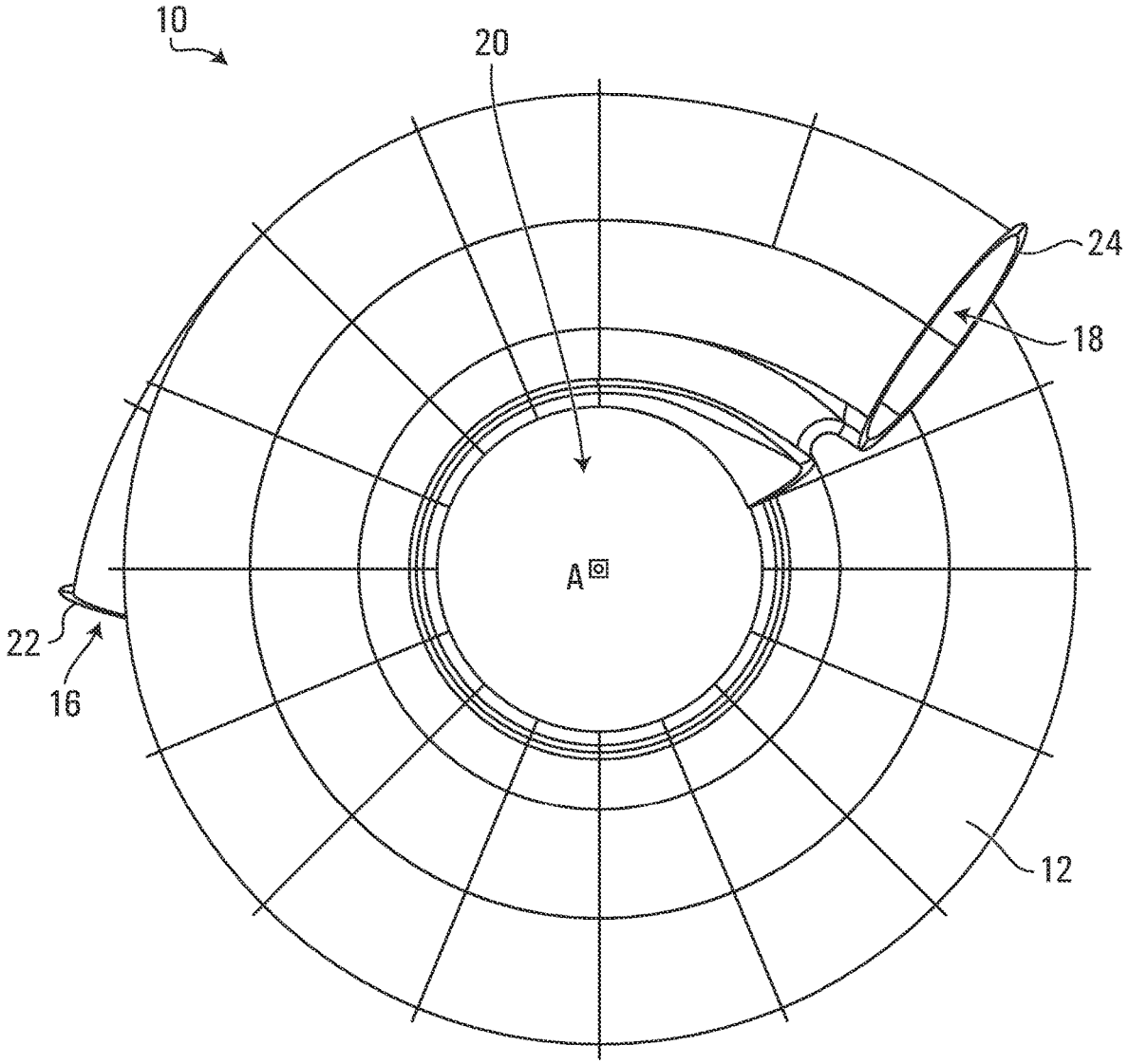
FIG. 6 is a bottom view of the slide feature of FIG. 1.
Figure 7:
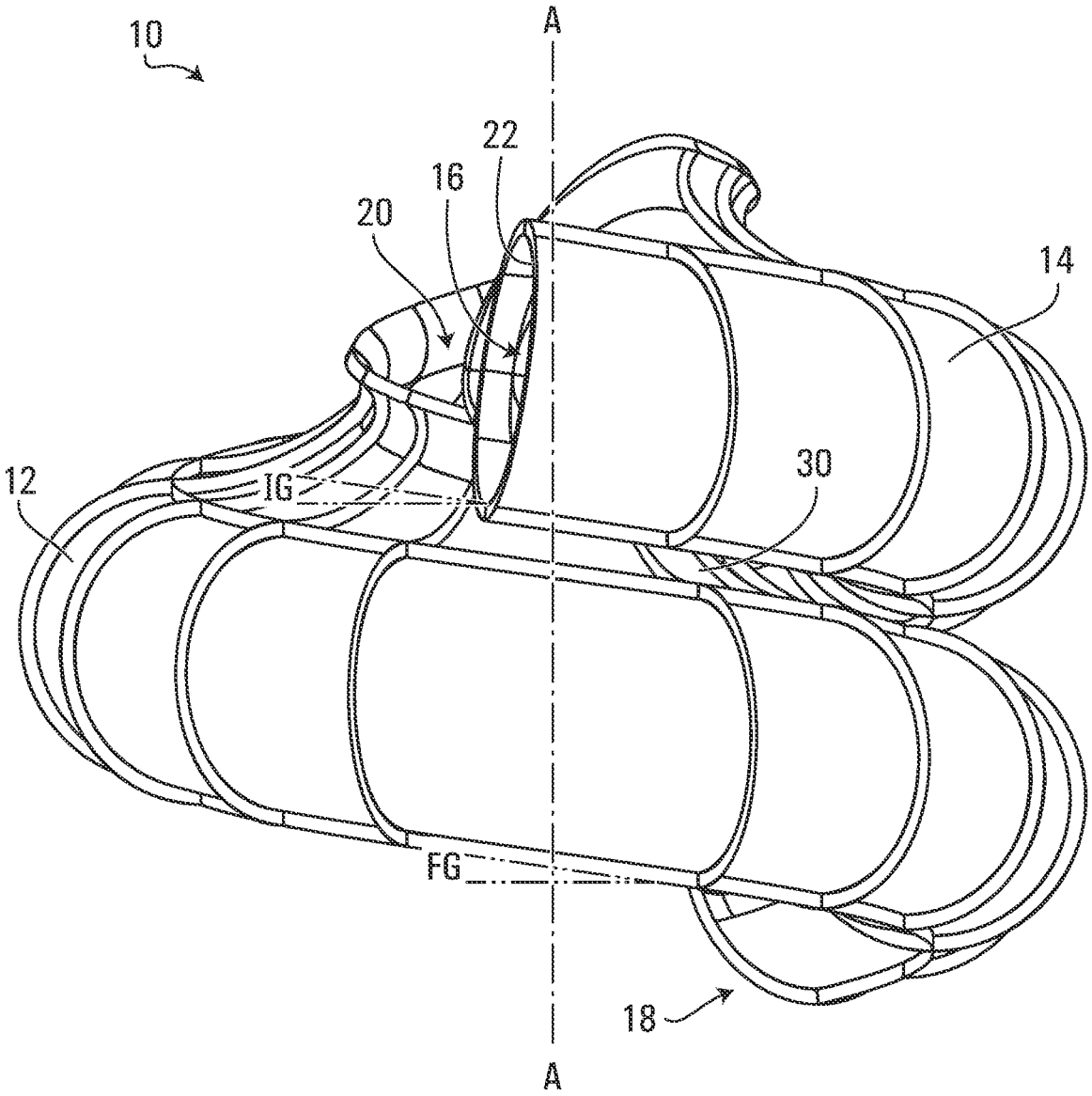
FIG. 7 is a first side view of the slide feature of FIG. 1.
Figure 8:
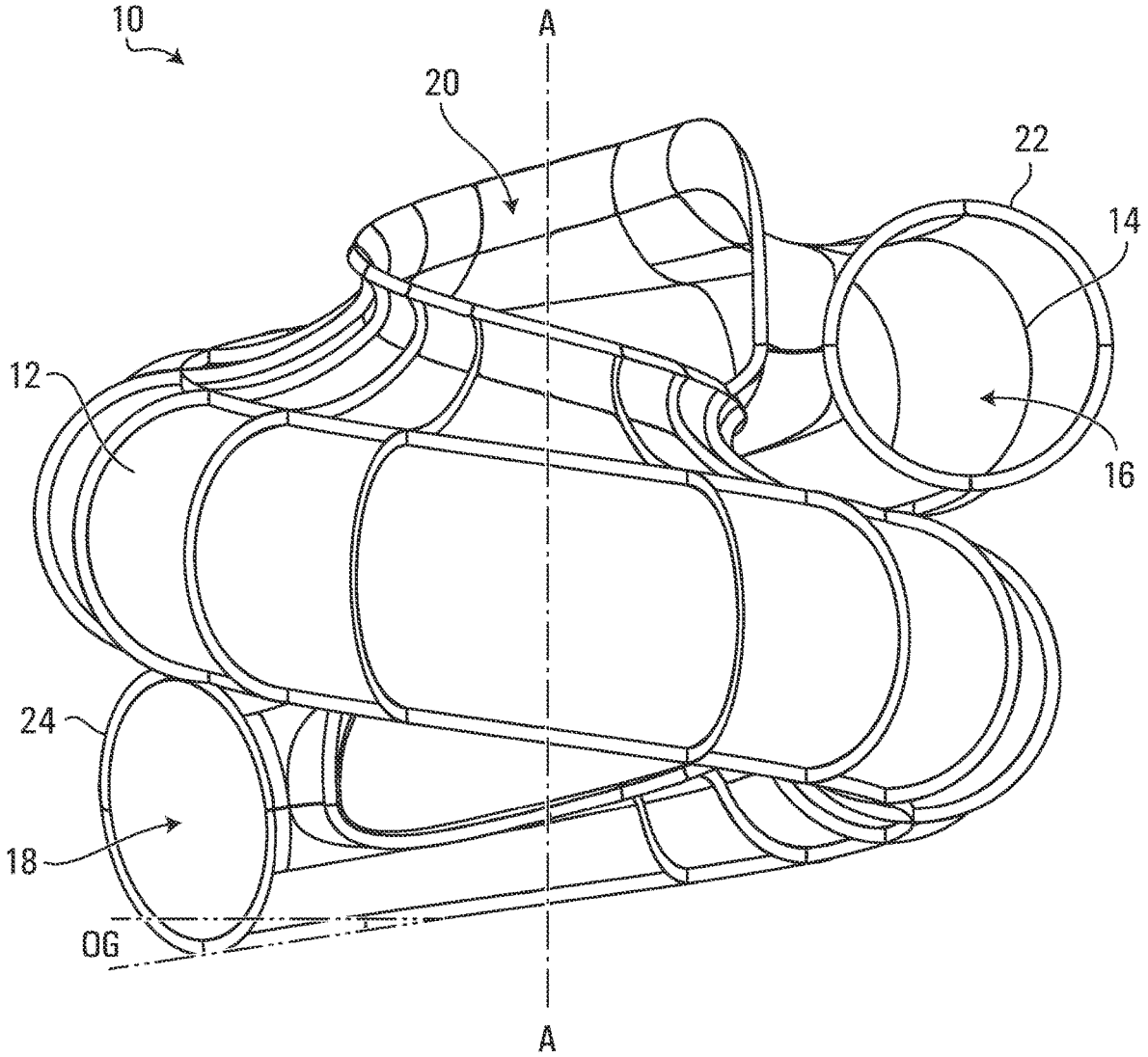
FIG. 8 is a second side view of the slide feature of FIG. 1.

Referring to FIGS. 1 through 8, one embodiment of a slide feature 10 according to the present disclosure is shown. The slide feature 10 is adapted to carry a rider or ride vehicle (not shown) sliding thereon. The slide feature 10 includes a substantially open flume 12, having sliding surface 14. The flume 12 is substantially open in that along at least a portion of its length, the cross-sectional shape of the flume 12 is not a completely closed curve, such as a circle, but is partially open (i.e. not closed), permitting riders a line of sight out of the flume and/or across the slide feature.

The slide feature 10 includes an inrun 16, permitting ingress into the flume 12 at a first elevation, and an outrun 18, permitting egress out of the flume at a second elevation. The first and second elevations may be different. In the embodiment shown, the second elevation is lower than the first elevation. Thus, riders travel through slide feature 10 at least partially urged by gravity. The inrun 16 permits a transition from a remainder of the water ride to the slide feature 10. Thus, for example, an inlet chute (not shown) may be connected to inrun 16. In the illustrated embodiment, the inrun 16 also transitions from a closed inlet chute or flume 10 at its start 22 to the open flume 12. In other embodiments, the inlet chute could be open. In yet other embodiments, the slide feature 10 may be preceded by another feature, including another slide feature 10 in a back-to-back configuration.

Similarly, the outrun 18 permits a transition from the slide feature 10 to a remainder of the water ride. Thus, for example, an outlet chute may be connected to outrun 18. In the illustrated embodiment the outrun 18 transitions from the open flume 12 to a closed flume or chute at its end 24. Other embodiments are also possible. For example, the inrun and/or outrun 16, 18 may transition from and to open inlet and/or outlet chutes, respectively. In other embodiments, the outlet chute may be open. In yet other embodiments, the slide feature 10 may be followed by another feature, including another slide feature 10 in a back-to-back configuration.

Riders, either without a ride vehicle or on ride vehicles, slide along the sliding surface 14 from the inrun 16 to the outrun 18. Ride vehicles typically include boats and rafts but, within the present disclosure, ride vehicles may also include mats, individual tubes, and any other device riders may use to slide through the feature.

The slide feature 10 defines an at least partially closed interior space 20. The space 20 is defined in part by the flume 12, which is open to the interior space 20. The flume 12 has a spiral or helical path around the interior space 20 with at least one turn. In the illustrated embodiment, the flume 12 has a helical progression from the inrun 16 to the outrun 18 with 1.325 turns (477° of rotation) from the start 22 of the inrun 16 to the end 24 of the outrun 18. One turn is a minimum of 360° between inrun and outrun. A flume gradient FG may be defined as the sloping of the flume 12 during the helical progression, which thereby defines a pitch of the helix. The flume gradient FG of the flume 12 may be different than the inrun gradient IG and outrun gradient OG of the inrun 16 and outrun 18, respectively. Similarly, the inrun and outrun gradients IG and OG may differ from each other. The inrun and outrun gradients IG and OG may be based on and configured to smoothen and facilitate the transition from and to inlet and outlet chutes, respectively.

In other embodiments, the number of turns may be higher or lower than in the illustrated embodiment. Any number of turns higher than one may be implemented according to the present disclosure.

In some embodiments, the flume 12 may be only partially open to the space 20. For example, the flume 12 may be initially open to the space 20 immediately after the inrun 16 but then be closed for a portion or all of the remainder of the flume before riders reach the outrun 18. More generally, in the context of the present disclosure, "open" flume 12 includes at least partially open flumes. In other embodiments, the flume 12 may be more open than in the illustrated embodiment with additional portions removed.

A radius of curvature R may be defined for the flume 12 with respect to a central axis A passing through the space 20 around which the flume 12 progresses. For each helical portion of the flume 12, as in the illustrated embodiment, the radius of curvature R is substantially constant. In a spiralling or combined helical and spiral flume 12, the radius of curvature R may vary continuously or stepwise along the progression of the flume 12, increasing, decreasing or both increasing and decreasing between the inrun 16 and outrun 18. In the illustrated embodiment, each of the inrun 16 and outrun 18 have different radii of curvature than the flume 12 and each other. This may facilitate transitions from and to inlet and outlet chutes, respectively.

Moreover, in some embodiments, the flume gradient FG may vary between the inrun and outrun, resulting in a varying pitch, either continuously or step wise.

The radius of curvature R of the flume 12 aids in balancing speed and centripetal forces as riders travel through the feature. Moreover, a larger radius of curvature for the inrun 16 that then decreases to match the radius of curvature R of the flume 12, results in a compounding radius effect that accelerates the rider into the feature, ensuring riders or ride vehicles bank higher within the flume 12. Similarly, the outrun 18 may have an increasing radius of curvature, beginning with the radius of curvature R of the flume 12, to decelerate riders and facilitate transition to a remainder of the ride.

Via the radii of curvature of the inrun 16 and outrun 18, as well as the inrun and outrun gradient IG and OG, the slide feature may be configured to accommodate a wide variety of inlet and outlet chutes and other geometries, permitting the slide feature to be incorporated into a wide variety of water rides.

In some embodiments, the cross-sectional profile of the flume 12 may differ from the inrun, outrun and/or may vary along the length of the flume. Thus, the inrun and outrun may also facilitate a transition to and from varying cross-sectional shapes and profiles of the flume 12, respectively. In some embodiments, a diameter of the cross-sectional profile of the flume may be larger or smaller than the inrun and outrun. The inrun and outrun flumes may also vary from each other.

Due to the at least one turn of the flume 12, a first part 26 of the flume 12 extends adjacent to and spaced from a second part 28 of the flume 12. In the illustrated embodiment, which has a helical progression of the flume 12 with a substantially constant radius of curvature R, the first part 26 extends immediately vertically above (in the z-direction) the second part 28. The size of the space between the first and second parts 26, 28 is a function of the pitch, or grade, of the helix of the flume 12, as well as the overall size, height and dimensions of the flume. In other embodiments, such as embodiments where the flume 12 spirals with a varying radius of curvature, the first part 26 may be at a higher elevation but not necessarily immediately above the second part 28 and may be more radially outward or inward of the second part 28.

A connecting wall portion 30 extends between the first and second parts 26, 28 to partially enclose the space 20. The partially enclosed space 20 permits the perception of a chamber, cave, cavern, or other enclosed space, which the rider enters upon transition from the inrun 16 into the flume 12. The open flume 12 permits a line of sight across the space 20 towards a future destination or past position of the rider as they travel along the flume 12. The presence of the at least partially enclosed space 20 may also permit auditory effects, such as echoes and reverberations, that amplify the rider's yells of excitement and other noises, further adding to the rider's thrill. The geometry of the space 20 may be defined at least in part to amplify and enhance such auditory effects.

An opening of the flume 12 may be defined between a top edge 32 and a bottom edge 34 of the flume 12. In the illustrated embodiment, the connecting wall portion 30 extends from the bottom edge 34 of the first part 26 to the top edge 32 of the second part 28. Specifically, as shown, the connecting wall portion 30 between these two edges has an inwardly curved progression, providing an appearance or perception of a continuous inner surface that extends from the sliding surface 14 of the first part 26 to the sliding surface 14 of the second part 28. As such, the edges 32 and 34 are not a distinct edge in the illustrated embodiment but may be considered to delineate the opening of the flume 12 past which a rider is not expected to travel during ordinary operation of the slide feature 10. Thus, the open flume 12 may be considered to have boundaries—whether formed by a physical feature, such as a lip, or not—that define the opening of the flume and which a rider is not intended to pass in order to remain safely within the flume 12. Edges 32 and 34 may also be referred to as such boundaries. The continuous and curved configuration of the connecting wall portion in the illustrated embodiment effectively hides the presence of the flume edges, further leading to a perception of a continuous chamber wall.

In other embodiments, the connecting wall portion 30 may extend between other portions of the first and second parts 26, 28 of the flume 12. For example, the connecting wall portion may extend from outer parts of the flume 12 to partially enclose the space 20 by spanning a portion of the space or gap between adjacent parts of the flume.

In the illustrated embodiment, the connecting wall portion is configured to also act as a lip to aid in containing riders within the flume 12 and to prevent riders from accidentally escaping the flume 12. The connecting wall portion 30 is configured as a lip by first extending up and inward before extending downward towards the second part 28 of the flume. Further along the flume 12, the connecting wall portion 30 merges continuously with a lip 31 that extends along the flume 12 towards the outrun 18 from the bottom edge 34.

In some embodiments, the interior space 20 may be at least partially enclosed by non-flume elements, such as structural elements. The connecting wall portion may not be a continuous surface.

In some embodiments, the inrun and first part of the flume may be open and may close after one revolution to the underside of the second part of the flume or the inrun. In some embodiments, a portion of the flume may itself form part of another feature. For example, the helical or spiral ride path followed by riders traveling through the flume may pass through another feature, such as an at least partially enclosed feature, which are connected.

In the illustrated embodiment, the slide feature 10 further includes a top wall portion 36 that at least partially encloses a top of the space 20. Specifically, in the illustrated embodiment, the top wall portion 36 extends from the top edge 32 and forms a top collar 38 that defines a top opening 40 of the space 20. The top wall portion 36 continuously merges with the connecting wall portion 30 approximately at a first merger location 42 as the top wall portion 36 follows the helical progression of the top edge 32. In the illustrated embodiment, the top wall portion 36 also extends from and continuously merges with a side wall 43 of the inrun 16 where the inrun 16 transitions from closed to open flume adjacent the start 22.

In the illustrated embodiment, the top wall portion 36 is curved inwards and extends continuously from the flume 12 effectively hiding the presence of the edge 32 and further aiding the appearance and feel of the space 20 as a chamber.

In other embodiments, the top wall portion 36 may fully close the space 20 such that the opening 40 is omitted. In other embodiments, the collar 38 and/or part or all of the top wall portion 36 may be omitted. In some embodiments, the top edge 32 of the flume 12 may define part of the opening 40.

In the illustrated embodiment, the slide feature 10 further includes a bottom wall portion 44 that at least partially encloses a bottom of the space 20. Specifically, in the illustrated embodiment, the bottom wall portion 44 extends from the bottom edge 34 of the flume 12 and forms a bottom collar 46 that defines bottom opening 48. The bottom wall portion 44 continuously merges with the connecting wall portion 30 approximately at a second merger location 50 as the bottom wall portion 44 follows the helical progression of the bottom edge 34. In the illustrated embodiment, the bottom wall portion 44 also extends from and continuously merges with a side wall 45 of the outrun 18 where the outrun 18 transitions from the open flume 12 to a closed flume adjacent the end 24.

In other embodiments, the bottom wall portion 44 may fully close the space 20 such that the opening 48 is omitted. In other embodiments, the collar 46 and/or part or all of the bottom wall portion 44 may be omitted. In some embodiments, the bottom edge 34 of the flume 12 may define part of the opening 48.

In the illustrated embodiment, the bottom wall portion 44 is curved inwards and extends continuously from the flume 12 effectively hiding the presence of the edge 34 and further aiding the appearance and feel of the space 20 as a chamber.

In some embodiments the connecting wall portion, top wall portion and/or bottom wall portion may be completed with non-flume elements, structural elements, themed elements or otherwise. Specifically, themed elements to further accentuate the partial or fully enclosed nature of the interior space may be added or used.

Other embodiments are possible. While the axis A in the illustrated embodiment extends vertically (i.e. in the z-direction), the axis A, and therefore the slide feature 10, may be tilted from the vertical in one or both of the x- and y-directions. Thus, in some configurations, depending on the radius of curvature and tilt of the axis A, an apex of riders' path through the slide feature 10, i.e. where riders reach their maximum elevation while travelling through the slide feature, may be between the inrun and outrun and not at the inrun as in the illustrated embodiment. Thus, in some embodiments, an apex of riders' path through the slide feature 10 may be at a higher elevation than both the first and second elevations of the inrun and outrun, respectively.

Similarly, in some embodiments, depending on the orientation of the slide feature 10, the riders may complete one or more loop-the-loops while travelling through the feature, including non-vertical loop-the-loops where the loop is oriented at an angle from the vertical z-direction.

Embodiments of the slide feature with more than one flume are also possible and the principles and embodiments discussed herein may be applicable mutatis mutandis to slide features with two or more flumes.

For example, in water rides having two or more separate lanes for riders to "race" through the ride, a slide feature according to the present disclosure, may have two or more open flumes configured in a double, triple or n-helix (or spiral), with each flume forming part of a separate, respective lane in the ride. One or more connecting wall portions would extend between the flumes or parts of a same flume to partially enclose the space on an interior of the flumes. In such embodiments, each flume would have a respective inrun and outrun to the feature. If riders enter the feature at approximately the same time, they may have a line of sight between them, as well as out of the feature if the space is not fully enclosed. This may further add to the thrill of "racing" in the water ride with two or more separate lanes.

Figure 9:
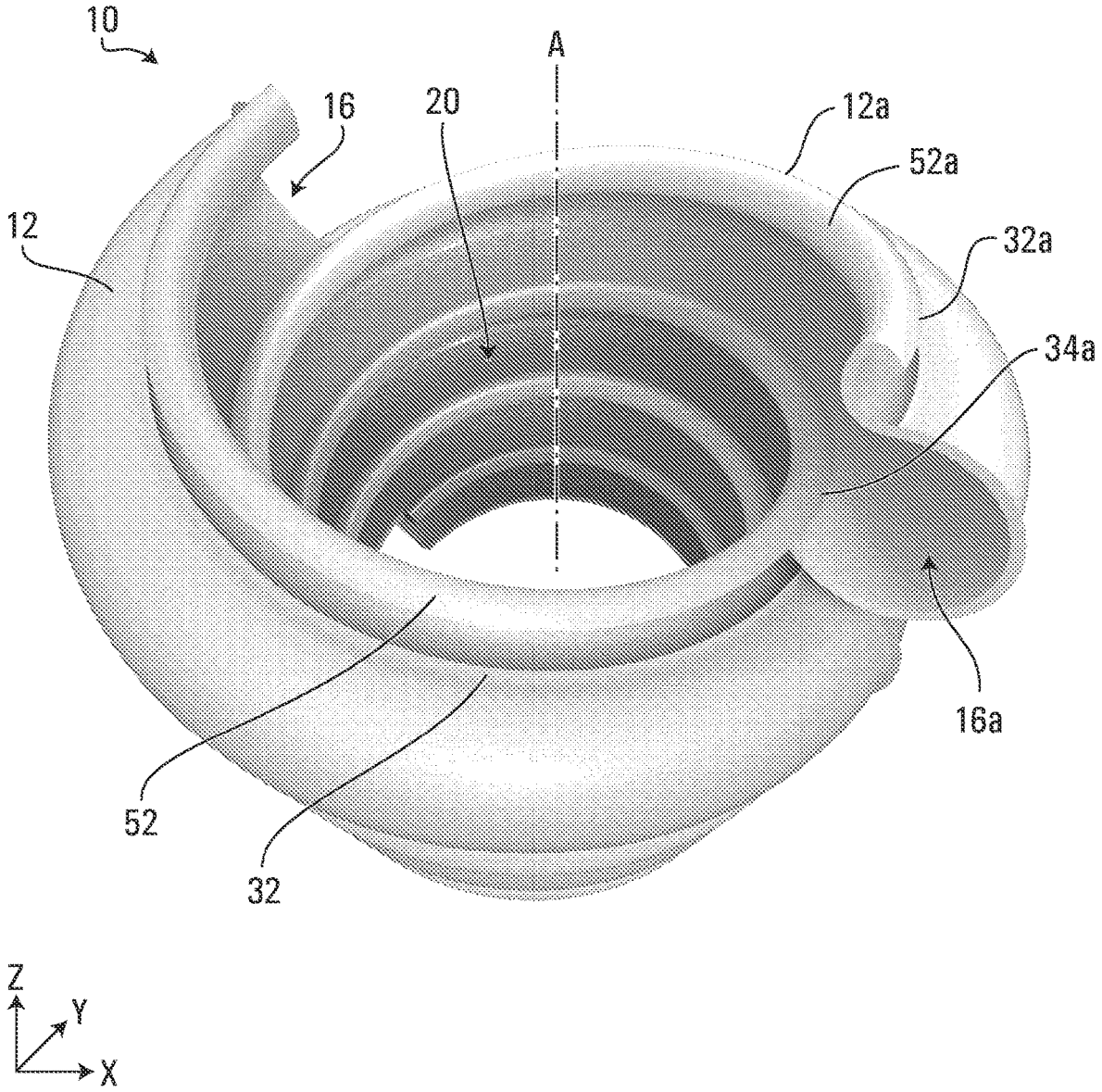
FIG. 9 is a top perspective view of a slide feature according to further embodiments of the present disclosure.
Figure 10:
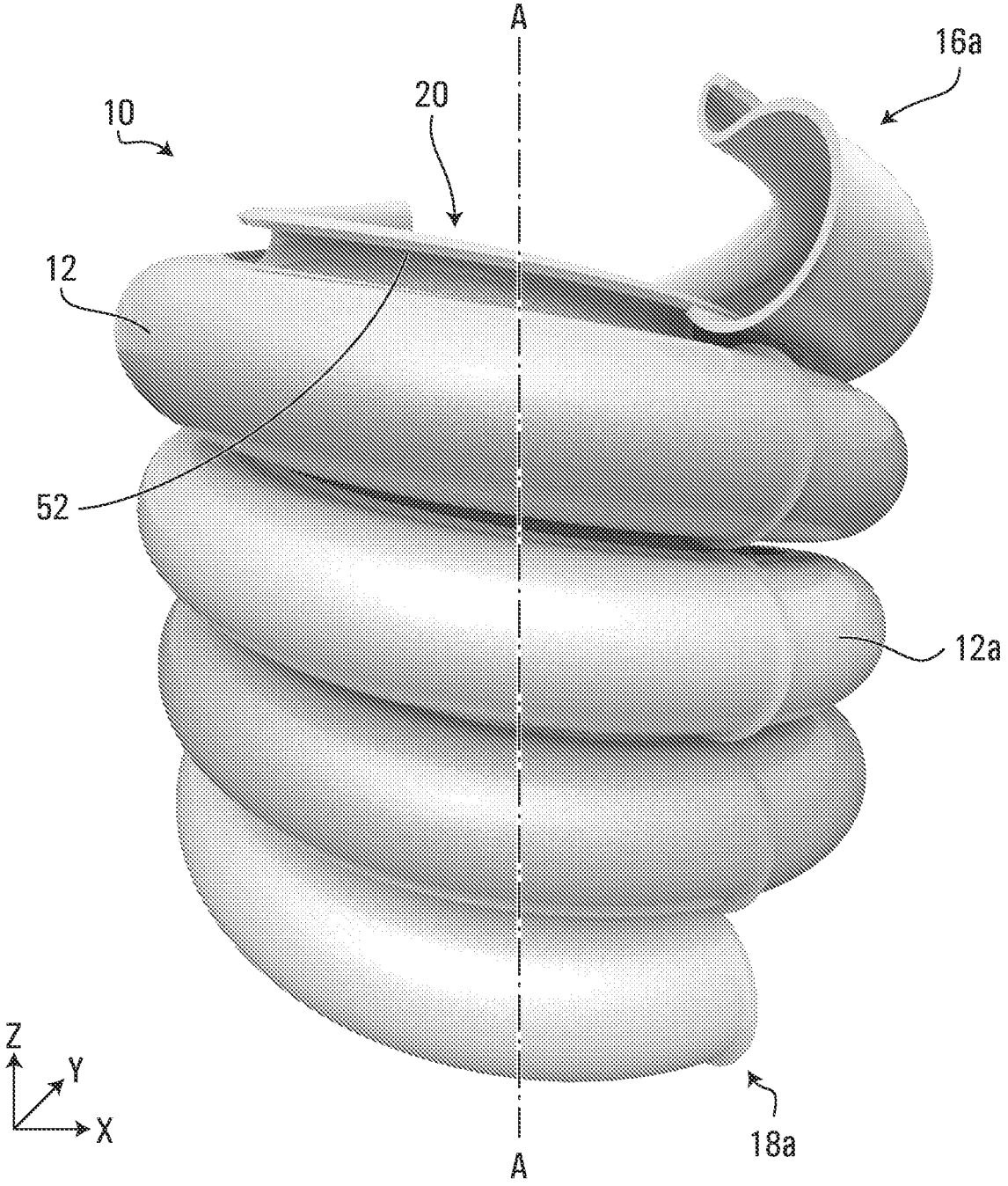
FIG. 10 is a further perspective view of the slide feature of FIG. 9.
Figure 11:
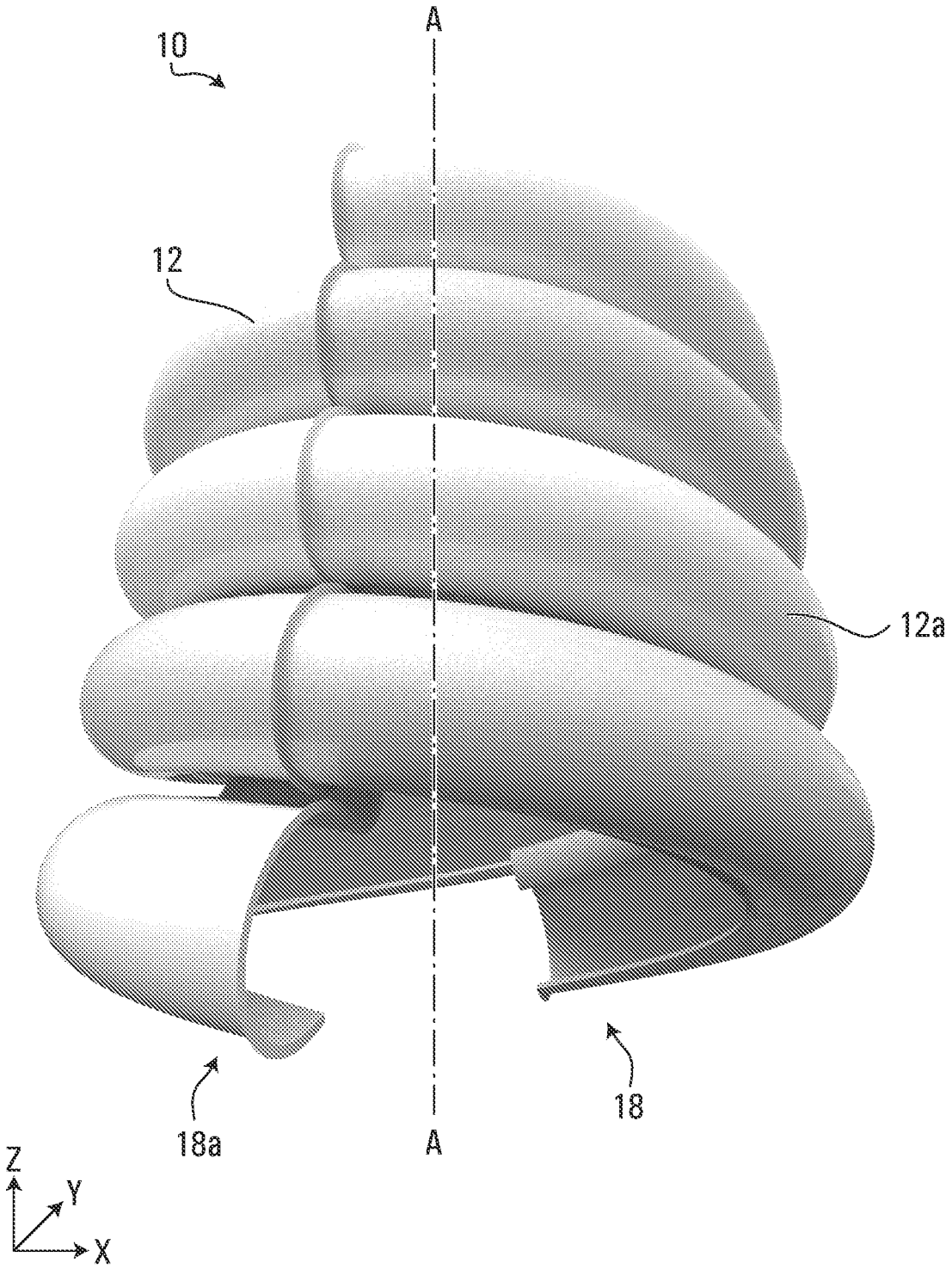
FIG. 11 is a bottom perspective view of the slide feature of FIG. 9.

Referring to FIGS. 9 to 11, one example embodiment of a slide feature 10 with a double helix configuration of lanes is shown. Like features to the embodiment of FIGS. 1 to 8 will be given like reference numerals. As shown, first and second flumes 12 and 12*a* progress helically and intertwined as a double helix around an axis A. Each of the flumes 12. 12*a* has a respective inrun 16, 16*a* and a respective outrun 18, 18*a*.

In the illustrated embodiment, the inruns 16 and 16*a* are positioned approximately a half revolution (i.e. 180 degrees) from each other such that riders would enter the slide feature at approximately the same time and be diametrically on opposite sides of the slide feature as they travel to the outruns. Riders would travel in the same sense through the feature, i.e. clockwise or counter-clockwise. Similarly, the outruns are positioned approximately a half revolution from each other such that riders exit the slide feature at approximately the same time. It will be understood that the travel time of riders through the slide feature depends on numerous factors such as rider speed and weight, amount of lubrication on the sliding surface, as well as the geometry of the slide feature 10.

In other embodiments, the inruns and/or outruns may be positioned at any other angles from each other.

As shown in the illustrated embodiment, the presence of the second flume 12*a* may aid in spanning the space between the first and second parts of the first flume 12 and vice versa, such that the interior space 20 may be partially enclosed by the presence of the flumes 12 and 12*a*. Depending on the pitch of each of the flumes, the spacing between the flumes may also be further spanned by one or more connecting wall portions or other structures as discussed above, which may extend from various parts of the flumes.

In some embodiments, the lower edge of the first flume 12 may merge with an upper edge of the second flume 12*a* and/or a connecting wall portion may be present to further span the space between the flumes. In the illustrated embodiment, a lip portion 52 extending from a top edge or boundary 32 of the first flume 12 extends over and/or merges with a bottom edge or boundary 34*a* of the second flume 12*a*. Similarly, a lip portion 52*a* extending from a top edge or boundary 32*a* of the second flume 12*a* extends over and/or merges with a bottom edge or boundary 34 of the first flume 12. Each of the lip portions 52, 52*a* may also act as a physical inner safety boundary to the flumes 12, 12*a* to aid in keeping riders within their respective flumes and preventing the riders from escaping the flume while travelling through the feature.

As with the embodiment of FIGS. 1 to 8, a multi-flume embodiment with two or more lanes may have any number of turns.

In the embodiment shown, both flumes have substantially similar radii of curvature and gradients. However, in other embodiments, each of the flumes may have different radii, gradients and/or dimensions from each other.

Figure 12:
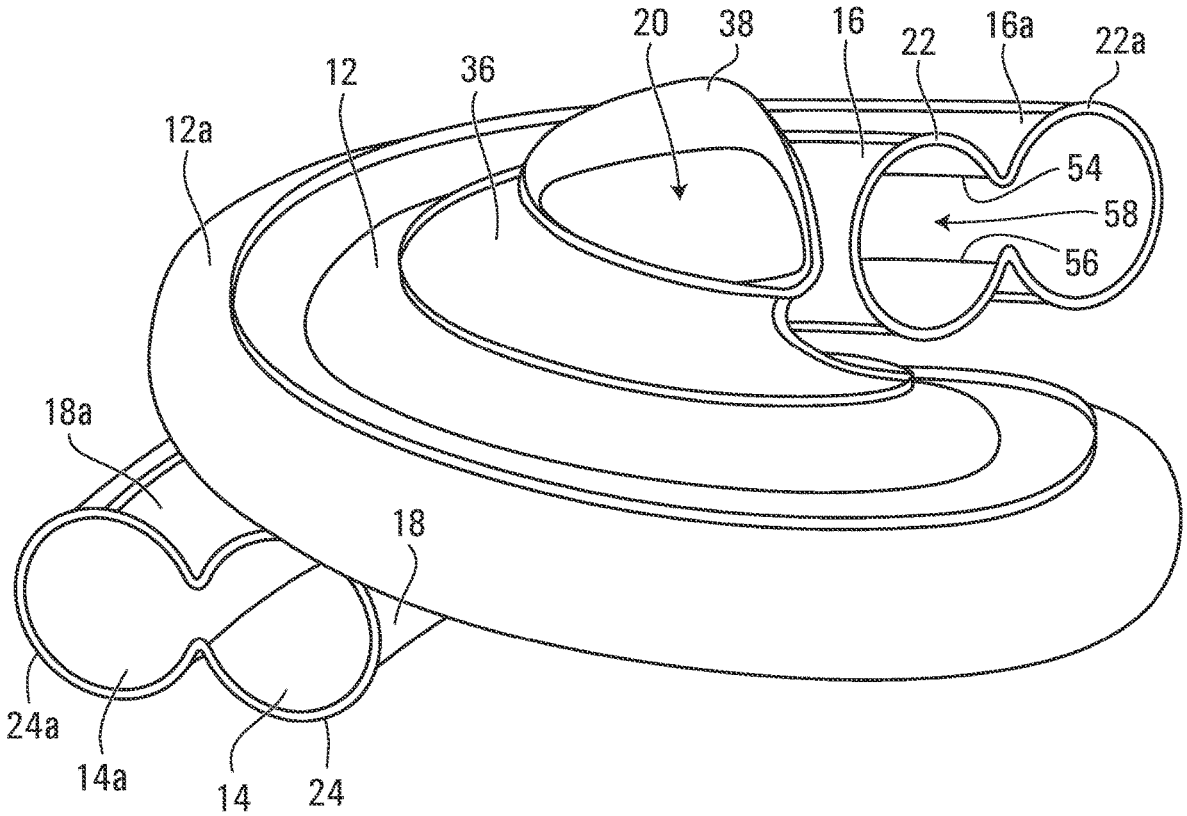
FIG. 12 is a top perspective view of a slide feature according to further embodiments of the present disclosure.

Referring to FIG. 12, a further example of a slide feature 10 with multiple flumes is shown. Like features will be given like reference numerals. First and second flumes 12 and 12*a* are arranged side-by-side and connected, extending from respective inruns 16, 16*a* to respective outruns 18, 18*a*. In the illustrated embodiment, flumes 12, 12*a* are separated by upper and/or lower partial dividing walls 54 and 56, which aid in keeping riders within their respective flumes but allow some visibility between the flumes through an opening 58 between the flumes 12, 12*a*. This may further add to a duelling or racing feel of the slide feature as riders are permitted to see each other's progress over at least portions of their travel through the slide feature 10. The opening 58 may also permit the transmission of auditory effects.

In some embodiments, the first and second flumes 12, 12*a* may be separated by a complete wall for all or part of the travel through the slide feature 10.

In the illustrated embodiment, the first flume 12 is located interior of the second flume 12*a*. The first flume 12 may be configured as part of the feature in a similar or identical manner as the flume 12 in the embodiment of FIGS. 1 to 8, meaning that the flume may be open to an interior space 20 of the slide feature 10. In turn, if the opening 58 is present between the flumes, riders in the outer, second flume 12*a* may share in the experience of an open connection to interior space 20 via the first flume 12. For example, echoes reverberating within the space 20 may reach riders in the outer, second flume 12*a*.

Inlet chutes leadings to flumes 12, 12*a* may be connected immediately preceding inruns 16, 16*a*. Similarly, outlet chutes leading from outruns 18, 18*a* may be connected immediately following outruns 18, 18*a*. In some embodiments, the chutes may be separated and not connected immediately preceding inruns 16, 16*a* and/or immediately following outrun 18, 18*a*. In some embodiments, immediately preceding inruns 16, 16*a* the riders may be separated by a complete dividing wall between the flumes or lanes so that they are not visible to each other, only becoming visible to each other upon entering the inruns 16, 16*a* to the slide feature 10. Similarly, the riders may be again separated by a dividing wall following the slide feature 10, while continuing in outlet chutes. It will be understood that variations of these configurations are possible and within the scope of the present disclosure. A complete dividing wall may transition to partial dividing walls 54, 56 and vice versa within the slide feature 10 at any point between inruns 16, 16*a* and outruns 18, 18*a*.

While the inruns 16, 16*a* and outruns 18, 18*a* are shown as closed (i.e. roofed) other configurations, such as open flumes, are also possible.

It will be appreciated that the travel path of riders in the inner flume is shorter than the path through the outer flume. Accordingly, the geometries, angles, and other aspects of the flumes may not be identical and/or modified to achieve desired travel times for riders through the inner and outer flumes.

In some embodiments, the first and second flumes 12, 12*a* may cross over each other, resulting in the first flume 12 being the inner flume at the inrun 16 but the outer flume as the outrun 18.

In some embodiments, more than two flumes may be arranged in a side by side fashion with the principles discussed above being applicable mutatis mutandis to such embodiments.

In some embodiments, such as the two-lane embodiment of FIGS. 9 to 12, the lanes may not originate from the same ride but originate from separate rides that then come together as part of the slide feature and then again separate or not. In other embodiments, multiple lanes or flumes (e.g. 3, 4 or more) may come together into a shared slide feature and then again separate or not.

Other configurations are also possible, for example where two or more flumes are arranged as stacked helices or spirals. In a stacked configuration, riders in each lane, if entering the feature at approximately the same time, would ride one above the other in their respective lanes rather than on opposite sides of the feature, as in the embodiment of FIGS. 9 to 11. Again one or more connecting wall portions would partially enclose the space defined by the flumes.

Yet other configurations and embodiments are also possible. In some embodiments of the feature with multiple lanes, two or more features each with one or more lanes may be intertwined in a manner to allow for one or more interior spaces to be at least partially enclosed.

According to some embodiments of the present disclosure, the connecting wall portion to partially enclose the space may extend between any part of the feature to another part of the feature. For example, in some embodiments, the flume may be partially or totally encased in a larger structure with one or more walls that provide riders with the impression that they are at least partially enclosed when travelling through the open flume. In other words, the interior space of the feature may not be at least partially enclosed due to wall portions extending between parts of the flume itself but instead the flume is positioned within an at least partially enclosed wall structure that enclosed part or all of the flume(s) as well as the interior space.

While embodiments have been described where, generally, riders would travel from a higher elevation at the inrun to a lower elevation at the outrun, in some embodiments, riders might travel up the feature from a lower elevation to a higher elevation. In such embodiments, accelerating systems, for example water jet propulsion or linear induction motor systems, would be used to accelerate riders into the feature and/or provide additional force to have riders climb the feature. Some such systems are sold by the applicant under the names of ROCKETBLAST® and HYDROMAGNETIC®. In some embodiments, the slide feature may be configured the same as embodiments in FIGS. 1 through 11 but with inrun and outrun reversed and riders travelling in an opposite sense through the feature. In other embodiments, the inrun, outrun and/or flume(s) would be modified to accommodate the upward motion of the riders.

Numerous specific details have been set forth in order to provide a more thorough understanding of the inventive concepts. However, it will be apparent to one of ordinary skill in the art that the inventive concepts within the instant disclosure may be practiced without these specific details. In other instances, well-known features have not been described in detail to avoid unnecessarily complicating the instant disclosure.

As used herein, the terms "comprises," "comprising." "includes," "including." "has," "having" or any other variation thereof, are intended to cover a nonexclusive inclusion. For example, a composition, a process, method, article, or apparatus that comprises a list of elements is not necessarily limited to only those elements but may include other elements not expressly listed or inherently present therein.

As used herein the terms "approximately," "about," "substantially" and variations thereof are intended to include not only the exact value qualified by the term, but to also include some slight deviations therefrom, such as deviations caused by measuring error, manufacturing tolerances, wear and tear on components or structures, stress exerted on structures, and combinations thereof, for example.

Use of the "a" or "an" are employed to describe elements and components of the embodiments herein. This is done merely for convenience and to give a general sense of the inventive concepts. This description should be read to include one or at least one and the singular also includes the plural unless it is obvious that it is meant otherwise.

Any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment. Moreover, it will be understood that features of one embodiment may be combined with features of other embodiments, even if not expressly recited or described as a combination.

The invention claimed is:

1. A slide feature for a water ride adapted to carry a rider or ride vehicle sliding thereon, the slide feature comprising:

an at least partially closed interior space partly defined by a flume open to the interior space, the flume having a spiral or helical path around the interior space with at least one turn such that a first part of the flume extends adjacent to and spaced from a second part of the flume, and a connecting wall portion spanning the space between the first and second parts of the flume to partially enclose the interior space;

an inrun permitting ingress into the flume;

an outrun permitting egress out of the flume; and a top wall portion to at least partially enclose a top of the interior space.

2. The slide feature of claim 1, wherein the connecting wall portion extends from the first part of the flume to the second part of the flume.

3. The slide feature of claim 1, wherein an opening of the open flume is defined between a top edge of the flume and a bottom edge of the flume, and wherein the connecting wall portion extends from the bottom edge of the first part of the flume to the top edge of the second part of the flume.

4. The slide feature of claim 3, wherein the connecting wall portion is curved inwards towards the interior space.

5. The slide feature of claim 1, wherein the top wall portion extends from the flume.

6. The slide feature of claim 5, wherein an opening of the open flume is defined between a top edge of the flume and a bottom edge of the flume, and wherein the top wall portion extends from the top edge of the flume.

7. The slide feature of claim 1, wherein the top wall portion merges with the connecting wall portion.

8. The slide feature of claim 1, wherein the top wall portion merges with a side wall of the inrun.

9. A slide feature for a water ride adapted to carry a rider or ride vehicle sliding thereon, the slide feature comprising:

an at least partially closed interior space partly defined by a flume open to the interior space, the flume having a spiral or helical path around the interior space with at least one turn such that a first part of the flume extends adjacent to and spaced from a second part of the flume, and a connecting wall portion spanning the space between the first and second parts of the flume to partially enclose the interior space;

an inrun permitting ingress into the flume;

an outrun permitting egress out of the flume; and a bottom wall portion to at least partially enclose a bottom of the interior space, wherein the bottom wall portion extends from the flume.

10. The slide feature of claim 9, wherein an opening of the open flume is defined between a top edge of the flume and a bottom edge of the flume, and wherein the bottom wall portion extends from the bottom edge of the flume.

11. The slide feature of claim 9, wherein the bottom wall portion merges with the connecting wall portion.

12. The slide feature of claim 9, wherein the bottom wall portion merges with a side wall of the outrun.

13. The slide feature of claim 1, wherein the flume has a helical or spiral path around an axis of the slide feature, the axis being vertical or tilted from the vertical.

14. A slide feature for a water ride adapted to carry a rider or ride vehicle sliding thereon, the slide feature comprising:

an at least partially closed interior space partly defined by a flume open to the interior space, the flume having a spiral or helical path around the interior space with at least one turn such that a first part of the flume extends adjacent to and spaced from a second part of the flume, and a connecting wall portion spanning the space between the first and second parts of the flume to partially enclose the interior space;

an inrun permitting ingress into the flume; and an outrun permitting egress out of the flume, wherein the flume has a helical path with a constant radius of curvature.

15. The slide feature of claim 1, wherein a radius of curvature of the inrun reduces from a start of the inrun until it matches a radius of curvature of the flume.

16. The slide feature of claim 1, wherein a radius of curvature of the outrun increases from a radius of curvature of the flume until an end of the outrun.

17. The slide feature of claim 1, wherein the inrun transitions from a closed flume to the open flume.

18. The slide feature of claim 1, wherein the outrun transitions from the open flume to a closed flume.

19. The slide feature of claim 1, wherein the flume is a first flume and the slide feature further comprises at least one flume arranged adjacent to the first flume with an opening arranged between the first flume and the adjacent flume.

20. The slide feature of claim 1, wherein the flume is a first flume and the slide feature further comprises one or more further flumes arranged in a helical configuration with the first flume.

21. The slide feature of claim 1, further comprising a bottom wall portion to at least partially enclose a bottom of the interior space, wherein the bottom wall portion extends from the flume.

22. The slide feature of claim 1, wherein the flume has a helical path with a constant radius of curvature.

23. The slide feature of claim 9, wherein the connecting wall portion extends from the first part of the flume to the second part of the flume.

24. The slide feature of claim 9, wherein an opening of the open flume is defined between a top edge of the flume and a bottom edge of the flume, and wherein the connecting wall portion extends from the bottom edge of the first part of the flume to the top edge of the second part of the flume.

25. The slide feature of claim 24, wherein the connecting wall portion is curved inwards towards the interior space.

26. The slide feature of claim 9, wherein the flume has a helical or spiral path around an axis of the slide feature, the axis being vertical or tilted from the vertical.

27. The slide feature of claim 9, wherein a radius of curvature of the inrun reduces from a start of the inrun until it matches a radius of curvature of the flume.

28. The slide feature of claim 9, wherein a radius of curvature of the outrun increases from a radius of curvature of the flume until an end of the outrun.

29. The slide feature of claim 9, wherein the inrun transitions from a closed flume to the open flume.

30. The slide feature of claim 9, wherein the outrun transitions from the open flume to a closed flume.

31. The slide feature of claim 9, wherein the flume is a first flume and the slide feature further comprises at least one flume arranged adjacent to the first flume with an opening arranged between the first flume and the adjacent flume.

32. The slide feature of claim 9, wherein the flume is a first flume and the slide feature further comprises one or more further flumes arranged in a helical configuration with the first flume.

33. The slide feature of claim 9, wherein the flume has a helical path with a constant radius of curvature.

34. The slide feature of claim 14, wherein the connecting wall portion extends from the first part of the flume to the second part of the flume.

35. The slide feature of claim 14, wherein an opening of the open flume is defined between a top edge of the flume and a bottom edge of the flume, and wherein the connecting wall portion extends from the bottom edge of the first part of the flume to the top edge of the second part of the flume.

36. The slide feature of claim 35, wherein the connecting wall portion is curved inwards towards the interior space.

37. The slide feature of claim 14, wherein the flume has a helical or spiral path around an axis of the slide feature, the axis being vertical or tilted from the vertical.

38. The slide feature of claim 14, wherein a radius of curvature of the inrun reduces from a start of the inrun until it matches a radius of curvature of the flume.

39. The slide feature of claim 14, wherein a radius of curvature of the outrun increases from a radius of curvature of the flume until an end of the outrun.

40. The slide feature of claim 14, wherein the inrun transitions from a closed flume to the open flume.

41. The slide feature of claim 14, wherein the outrun transitions from the open flume to a closed flume.

42. The slide feature of claim 14, wherein the flume is a first flume and the slide feature further comprises at least one flume arranged adjacent to the first flume with an opening arranged between the first flume and the adjacent flume.

43. The slide feature of claim 14, wherein the flume is a first flume and the slide feature further comprises one or more further flumes arranged in a helical configuration with the first flume.

* * * * *